US011048184B2

(12) United States Patent
Sriskandha et al.

(10) Patent No.: US 11,048,184 B2
(45) Date of Patent: Jun. 29, 2021

(54) TONER PROCESS EMPLOYING DUAL CHELATING AGENTS

(71) Applicant: Xerox Corporation, Norwalk, CT (US)

(72) Inventors: Shivanthi Easwari Sriskandha, Mississauga (CA); Richard P. N. Veregin, Mississauga (CA); Guerino G. Sacripante, Oakville (CA); Edward G. Zwartz, Mississauga (CA); Michael Steven Hawkins, Cambridge (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/246,898

(22) Filed: Jan. 14, 2019

(65) Prior Publication Data

US 2020/0225598 A1 Jul. 16, 2020

(51) Int. Cl.

| | |
|---|---|
| ***G03G 9/08*** | (2006.01) |
| ***G03G 9/093*** | (2006.01) |
| ***G03G 9/097*** | (2006.01) |
| ***G03G 15/08*** | (2006.01) |
| ***G03G 9/087*** | (2006.01) |

(52) U.S. Cl.

CPC ..... *G03G 9/09775* (2013.01); *G03G 9/0806* (2013.01); *G03G 9/0819* (2013.01); *G03G 9/08711* (2013.01); *G03G 9/09364* (2013.01); *G03G 9/09392* (2013.01); *G03G 15/0889* (2013.01)

(58) Field of Classification Search

CPC ..... G03G 9/09775; G03G 9/0819; G03G 9/08711; G03G 15/0889; G03G 9/09364; G03G 9/0806; G03G 9/09392

See application file for complete search history.

(56) References Cited

U.S. PATENT DOCUMENTS

| | | | |
|---|---|---|---|
| 3,590,000 | A | 6/1971 | Palermiti et al. |
| 3,847,604 | A | 11/1974 | Hagenbach et al. |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,236,629 | A | 8/1993 | Mahabadi et al. |
| 5,290,654 | A | 3/1994 | Sacripante et al. |
| 5,330,874 | A | 7/1994 | Mahabadi et al. |
| 5,344,738 | A | 9/1994 | Kmiecik-lawrynowicz et al. |
| 5,346,797 | A | 9/1994 | Kmiecik-lawrynowicz et al. |
| 5,496,676 | A | 3/1996 | Croucher et al. |
| 5,501,935 | A | 3/1996 | Patel et al. |
| 5,747,215 | A | 5/1998 | Ong et al. |
| 5,840,462 | A | 11/1998 | Foucher et al. |
| 5,869,215 | A | 9/1999 | Ong et al. |
| 6,063,827 | A | 5/2000 | Sacripante et al. |
| 6,214,507 | B1 | 4/2001 | Sokol et al. |
| 6,593,049 | B1 | 7/2003 | Veregin et al. |
| 6,756,176 | B2 | 6/2004 | Stegamat et al. |
| 6,828,073 | B2 | 12/2004 | Matsumura et al. |
| 6,830,860 | B2 | 12/2004 | Sacripante et al. |
| 6,890,696 | B2 | 5/2005 | Farrugia et al. |
| 6,936,396 | B2 | 8/2005 | Patel |
| 7,037,633 | B2 | 5/2006 | Hopper et al. |
| 7,049,042 | B2 | 5/2006 | Hopper et al. |
| 7,160,661 | B2 | 1/2007 | Moffat et al. |
| 7,179,575 | B2 | 2/2007 | Moffat et al. |
| 7,186,494 | B2 | 3/2007 | Ahuja et al. |
| 7,217,484 | B2 | 5/2007 | Marcello et al. |
| 7,618,761 | B2 * | 11/2009 | Shoji ..... G03G 9/0819 430/109.1 |
| 7,749,672 | B2 | 7/2010 | Farrugia |
| 7,754,406 | B2 | 7/2010 | Vanbesien et al. |
| 7,767,376 | B2 | 8/2010 | Mang et al. |
| 7,781,138 | B2 | 8/2010 | Sacripante et al. |
| 7,817,944 | B2 | 10/2010 | Li |
| 7,822,370 | B2 | 10/2010 | Himes |
| 7,829,253 | B2 | 11/2010 | Sweeney et al. |
| 7,858,285 | B2 | 12/2010 | Sacripante et al. |
| 7,862,971 | B2 | 1/2011 | Moffatt et al. |

(Continued)

FOREIGN PATENT DOCUMENTS

EP 0794469 A1 * 9/1997 ..... G03G 15/6508

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Briggs, John C. and Ming-Kai Tse. "The Effect of Fusing on Gloss in Electrophotography" IS&T's NIP14 International Conference on Digital Printing Technologies, Oct. 18-23, 1998, Toronto, Ontario, Canada.*

Pettersson, Torbjörn and Andrew Fogden. "Leveling During Toner Fusing: Effects on Surface Roughness and Gloss of Printed Paper" Journal of Imaging Science and Technology 50(2): pp. 202-215, 2006.*

*Primary Examiner* — Christopher D Rodee

(74) *Attorney, Agent, or Firm* — Marylou J. Lavoie, Esq. LLC

(57) ABSTRACT

A toner process including a) mixing reagents comprising at least one amorphous resin, an optional crystalline resin, an optional styrene, acrylate or styrene/acrylate, an optional wax, and an optional colorant to form an emulsion comprising a resin particle; b) adding at least one aggregating agent and aggregating said resin particle to form a nascent toner particle; c) optionally, adding one or more resins to form a shell on said nascent toner particle to yield a core-shell particle; d) adding a first chelating agent and a second chelating agent; wherein said first chelating agent and said second chelating agent are different; e) freezing particle growth to form an aggregated toner particle; f) coalescing said aggregated toner particle to form a toner particle; and g) optionally, collecting said toner particle.

10 Claims, No Drawings

(56) References Cited

U.S. PATENT DOCUMENTS

| | | | | |
|---|---|---|---|---|
| 8,195,077 | B2 * | 6/2012 | Moteki | G03G 15/6585 399/341 |
| 9,454,095 | B2 | 9/2016 | Miyamoto | |
| 9,612,549 | B1 | 4/2017 | Vanbesien et al. | |
| 2011/0207044 | A1 * | 8/2011 | Zwartz | G03G 9/08755 430/105 |
| 2011/0250536 | A1 | 10/2011 | Veregin et al. | |
| 2015/0153663 | A1 | 6/2015 | Sheik-qasim | |
| 2015/0153672 | A1 * | 6/2015 | Kmiecik-Lawrynowicz | G03G 9/0819 430/108.21 |

* cited by examiner

TONER PROCESS EMPLOYING DUAL CHELATING AGENTS

BACKGROUND

Disclosed herein is a toner process comprising a) mixing reagents comprising at least one amorphous resin, an optional crystalline resin, an optional styrene, acrylate or styrene/acrylate, an optional wax, and an optional colorant to form an emulsion comprising a resin particle; b) adding at least one aggregating agent and aggregating said resin particle to form a nascent toner particle; c) optionally, adding one or more resins to form a shell on said nascent toner particle to yield a core-shell particle; d) adding a first chelating agent and a second chelating agent; wherein said first chelating agent and said second chelating agent are different; e) freezing particle growth to form an aggregated toner particle; f) coalescing said aggregated toner particle to form a toner particle; and g) optionally, collecting said toner particle. Further disclosed is a toner prepared with the toner process. Further disclosed is a cartridge comprising a storage portion and a delivery portion, wherein said toner cartridge contains a toner prepared with the toner process.

Emulsion aggregation (EA) toner particles may comprise polyester resins, which are aggregated to form structures of a desired shape and size, followed by the coalescence of the aggregated particles, for example, at an elevated temperature. The components incorporated into the toner shape the characteristics of the final toner particles. For example, a colorant may be added, a wax may be added to provide release from a fuser roll, and a particular binder resin may be added to provide a low minimum fusing temperature (MFT). Another toner property which may be controlled by the components of the EA toner particles is fused image gloss. Examples of teachings of materials and methods for making EA toner include U.S. Pat. Nos. 5,290,654; 5,344,738; 5,346,797; 5,496,676; 5,501,935; 5,747,215; 5,840,462; 5,869,215; 6,828,073; 6,890,696; 6,936,396; 7,037,633; 7,049,042; 7,160,661; 7,179,575; 7,186,494; 7,217,484; 7,767,376; 7,829,253; 7,858,285; and 7,862,971, the disclosure of each hereby is incorporated by reference in entirety.

Toners with higher pigment loadings, such as required for high-yield (HY) (or hyperpigmented) toners or smaller sized toners, such as those less than 4 μm in size, can have long aggregation times. One solution is to reduce the solids loading, which reduces aggregation time, but at the expense of yield and process cost. A second solution is to increase freeze temperature, which reduces aggregation time, but results in higher residual metal ion levels, as the increased aggregation temperature traps greater amounts of metal ion in and on the toner particle, resulting in uncontrollable or lower gloss. However, at higher pigment loadings, increasing freeze temperature is not sufficient to provide both a reasonable aggregation time and lower metal ion content at the prevailing solids loading amount in commercial toners.

Further, low melt toners having a smaller particle size, in embodiments, about 4.7 micrometers, and lower melting performance, in embodiments, having a minimum fix temperature of about 15° C. less than currently available toners, are desired.

Many emulsion aggregation processes use sodium hydroxide solution and optionally smaller amounts of ethylene diamine tetraacetic acid (EDTA) to increase pH to freeze aggregation. With higher residual metal cation in the toner particle, gloss is lowered. That relationship is relevant in uses with lower toner mass per unit area (TMA) applications, such as, hyperpigmented toner and smaller sized toner, since lower TMA also reduces gloss.

It is desirable to enable a higher residual aluminum in a toner without adversely affecting toner properties such as gloss. It is also desirable to improve overall toner image quality. One method proposed has been to increase toner mass per unit area to improve toner image quality. A problem with this approach is that gloss is increased unless residual aluminum is also increased. Lowering the amount of EDTA can increase residual aluminum and thus result in reduced gloss. However, this approach can result in difficulties in preparing certain toners, in embodiments magenta toners that are prepared with certain crystalline polyester resins.

U.S. Patent Publication 2015/0153663, which is hereby incorporated by reference herein in its entirety, describes in the Abstract thereof an emulsion aggregation toner process that does not require addition of base to freeze toner particle growth.

Currently available toner compositions and processes are suitable for their intended purposes. However a need remains for improved toners and toner processes. Further, a need remains for an improved toner process that enables the presence of increased residual metal, such as increase residual aluminum, without adversely impacting toner function and toner print quality.

The appropriate components and process aspects of the each of the foregoing U. S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a toner process comprising a) mixing reagents comprising at least one amorphous resin, an optional crystalline resin, an optional styrene, acrylate or styrene/acrylate, an optional wax, and an optional colorant to form an emulsion comprising a resin particle; b) adding at least one aggregating agent and aggregating said resin particle to form a nascent toner particle; c) optionally, adding one or more resins to form a shell on said nascent toner particle to yield a core-shell particle; d) adding a first chelating agent and a second chelating agent; wherein said first chelating agent and said second chelating agent are different; e) freezing particle growth to form an aggregated toner particle; f) coalescing said aggregated toner particle to form a toner particle; and g) optionally, collecting said toner particle.

Also described is a toner comprising at least one amorphous resin, an optional crystalline resin, an optional styrene, acrylate or styrene/acrylate, an optional wax, and an optional colorant; wherein the toner is formed using a first chelating agent and a second chelating agent; wherein said first chelating agent and said second chelating agent are different; wherein said first chelating agent has a first ability to remove metal from the toner particle; wherein said second chelating agent has a second ability to remove metal from the toner particle; and wherein said first ability to remove metal from the toner particle and said second ability to remove metal from the toner particle are different.

Also described is a toner cartridge comprising a storage portion and a delivery portion, said cartridge comprising a toner prepared by a process comprising a) mixing reagents comprising at least one amorphous resin, an optional crystalline resin, an optional styrene, acrylate or styrene/acrylate, an optional wax, and an optional colorant to form an emulsion comprising a resin particle; b) adding at least one aggregating agent and aggregating said resin particle to form a nascent toner particle; c) optionally, adding one or more resins to form a shell on said nascent toner particle to yield a core-shell particle; d) adding a first chelating agent and a second chelating agent; wherein said first chelating agent and said second chelating agent are different; e) freezing particle growth to form an aggregated toner particle; f) coalescing said aggregated toner particle to form a toner particle; and g) optionally, collecting said toner particle.

DETAILED DESCRIPTION

A toner process is provided comprising a) mixing reagents comprising at least one amorphous resin, an optional crystalline resin, an optional styrene, acrylate or styrene/acrylate, an optional wax, and an optional colorant to form an emulsion comprising a resin particle; b) adding at least one aggregating agent and aggregating said resin particle to form a nascent toner particle; c) optionally, adding one or more resins to form a shell on said nascent toner particle to yield a core-shell particle; d) adding a first chelating agent and a second chelating agent; wherein said first chelating agent and said second chelating agent are different; e) freezing particle growth to form an aggregated toner particle; f) coalescing said aggregated toner particle to form a toner particle; and g) optionally, collecting said toner particle.

Chelating Agent.

The present disclosure demonstrates that toner particles having desired characteristics can be prepared using a combination of a first chelating agent and a second chelating agent, wherein the first chelating agent and the second chelating agent are different. In embodiments, the toner process is an emulsion aggregation process employing two different chelating agents each having a different ability to extract metal, in embodiments, aluminum, from the toner particle.

In embodiments, a first chelating agent is selected wherein the first chelating agent has a first ability to remove metal, in embodiments, aluminum, from the toner particle; and a second chelating agent is selected wherein the second chelating agent has a second ability to remove metal from the toner particle; wherein said first ability to remove metal from the toner particle and said second ability to remove metal from the toner particle are different.

In certain embodiments, the first chelating agent has the characteristic of removing a first amount of metal, in embodiments, aluminum, from the toner particle; the second chelating agent has the characteristic of removing a second amount of metal, in embodiments, aluminum, from the toner particle; wherein the first amount of metal is greater than the second amount of metal. That is, the ability to remove metal from the toner is greater in the first chelating agent and less in the second chelating agent.

Any suitable or desired chelating agent can be selected for the first and second chelating agent for the toner processes herein. In embodiments, the first chelating agent is selected from the group consisting of ethylene diamine tetra acetic acid (EDTA), gluconal, hydroxyl-2.2"iminodisuccinic acid (HIDS), dicarboxylmethyl glutamic acid (GLDA), methyl glycidyl diacetic acid (MGDA), hydroxydiethyliminodiacetic acid (HIDA), potassium citrate, Sodium citrate, nitrotriacetate salt, humic acid, glutamic acid, gluconic acid, N,N'-diacetic acid [also called ethylenediamine-N,N'-diacetic Acid], fulvic acid, hydroxyethylethylene diaminetriacetic acid (HEDTA), hydroxyethylidene diphosphonioacid (HEDP), humic acid, pentaacetic acid, tetraacetic acid, methylglycine diacetic acid, ethylenediamine disuccinic acid, salts of oxycarboxylic acids, such as, tartaric acid, imino diacid (IDA), nitrilotriacetic acid (NTA), salts of aminopoly carboxylic acids; salts of EDTA, such as, alkali metal salts of EDTA, tartaric acid, oxalic acid, polyacrylates, sugar acrylates, citric acid, polyaspartic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, salts of such compounds, and mixtures thereof. In a specific embodiment, the first chelating agent is ethylene diamine tetra acetic acid.

In embodiments, the second chelating agent is selected from the group consisting of ethylene diamine tetra acetic acid (EDTA), gluconal, hydroxyl-2.2"iminodisuccinic acid (HIDS), dicarboxylmethyl glutamic acid (GLDA), methyl glycidyl diacetic acid (MGDA), hydroxydiethyliminodiacetic acid (HIDA), potassium citrate, Sodium citrate, nitrotriacetate salt, humic acid, glutamic acid, gluconic acid, N,N'-diacetic acid [also called ethylenediamine-N,N'-diacetic Acid], fulvic acid, hydroxyethylethylene diaminetriacetic acid (HEDTA), hydroxyethylidene diphosphonioacid (HEDP), humic acid, pentaacetic acid, tetraacetic acid, methylglycine diacetic acid, ethylenediamine disuccinic acid, salts of oxycarboxylic acids, such as, tartaric acid, imino diacid (IDA), nitrilotriacetic acid (NTA), salts of aminopoly carboxylic acids; salts of EDTA, such as, alkali metal salts of EDTA, tartaric acid, oxalic acid, polyacrylates, sugar acrylates, citric acid, polyaspartic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, hydroxyiminodisuccinic acid, salts of such compounds, and mixtures thereof. In a specific embodiment, the second chelating agent is ethylene hydroxyiminodisuccinic acid.

The first and second chelating agents can be added during the toner process in any suitable or desired amount. In embodiments, the first chelating agent is added in an amount of from about 0.1 to about 1.1, or from about 0.45 to about 1.05, or from about 0.45 to about 0.56 percent by weight, based upon the total weight of the reagents in the toner process.

In embodiments, the second chelating agent is added in an amount of from about 0.1 to about 1.1, or from about 0.45 to about 1.05, or from about 0.45 to about 0.56 percent by weight, based upon the total weight of the reagents in the toner process.

In certain embodiments, the first chelating agent having the greater ability to remove metal from the toner is added in an amount that is greater than the amount of the second chelating agent have the lesser ability to remove metal from the toner.

In embodiments, the first chelating agent is added in an amount of from about 0.1 to about 1.1 percent by weight, and the second chelating agent is added in an amount of from about 0.1 to about 1.1 percent by weight, based upon the total weight of the reagents used in the toner process.

In certain embodiments, the total amount of chelating agent including both the first chelating agent and the second chelating agent is from about 0.8 to about 2 percent by weight, or from about 0.9 to about 1 percent by weight, or about 1.05 percent by weight, based upon the total weight of the reagents used in the toner process.

The first and second chelating agent can be added at any suitable or desired time during the emulsion aggregation toner process. In embodiments, the first chelating agent and the second chelating agent are added during the freezing step. In embodiments, the first chelating agent and the second chelating agent are added during step e) freezing particle growth to form an aggregated toner particle.

The first chelating agent and the second chelating agent can be added in any suitable or desired order. In embodiments, the first chelating agent is added first and the second chelating agent is added second. In certain embodiments, the first chelating agent is added first and the second chelating agent is added second, with both chelating agents being added during the freezing step. In embodiments, the first chelating agent is added during step e) freezing particle growth to form an aggregated toner particle and the second chelating agent is added during step e) freezing particle growth to form an aggregated toner particle after the addition of the first chelating agent.

The formed toner particle of f) may comprise a residual metal content of from about 100 to about 500 ppm (parts per million). In embodiments, the formed toner particle has a residual amount of aluminum of from about 100 ppm (parts per million) to about 500 ppm, or from about 200 ppm to about 500 ppm, or from about 300 ppm to about 500 ppm. In embodiments, the formed toner particle of f) comprises an aluminum content of greater than about 150 ppm. In embodiments, the formed toner particle of step f) comprises from about 100 to about 500 parts per million residual aluminum. In embodiments, the formed toner particle of step f) comprises from about 100 to about 500 parts per million residual aluminum, as measured by an inductively coupled plasma (ICP) spectrometer based on the total concentration of the element in parts per million within the sample, compared to a calibration curve. See U.S. Pat. No. 9,454,095, which is hereby incorporated by reference herein in its entirety.

In embodiments, an emulsion aggregation toner process is provided using two different chelating agents with differing ability to extract aluminum from the toner particle. Good toner particles were prepared using a combination of first and second chelating agent, in embodiments, using a combination resulting in 1.05% total amount of chelating agent, in embodiments, 0.56% EDTA and 0.45% HIDS. The 0.45% HIDS was effective to tie up loose aluminum in the coalescence, thus preventing coarse, but it doesn't effectively remove aluminum from the particle, therefore keeping the gloss from increasing. The result is higher aluminum, enabling required gloss. If 1.50% EDTA is used without the use of HIDS, good particles can be achieved, but the residual aluminum is much lower and the gloss is elevated.

Advantageously, EDTA is inexpensive and the amount used is small, therefore, cost is not impacted.

Resin.

Toner particles of the instant disclosure may comprise any known resin as known in the art as suitable therefor. In embodiments, bifunctional reagents, trifunctional reagents and so on may be used. One or more reagents that comprise at least three functional groups can be incorporated into a polymer or into a branch to enable branching, further branching and/or crosslinking. Examples of such polyfunctional monomers for a polyester include 1,2,4-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane and 1,2,7,8-octanetetracarboxylic acid, acid anhydrides thereof, lower alkyl esters thereof and so on. The branching agent may be used in an amount from about 0.01 to about 10 mole %, from about 0.05 to about 8 mole %, from about 0.1 to about 5 mole %. Polyester resins, for example, may be used for applications requiring low melting temperature.

One, two or more polymers may be used in forming a toner or toner particle. In embodiments where two or more polymers are used, the polymers may be in any suitable ratio (e.g., weight ratio) such as, for instance, with two different polymers, from about 1% (first polymer)/99% (second polymer) to about 99% (first polymer)/1% (second polymer), from about 10% (first polymer)/90% (second polymer) to about 90% (first polymer)/10% (second polymer) and so on, as a design choice.

In embodiments, the polymer may be present in an amount of from about 65 to about 95% by weight, from about 75 to about 85% by weight of toner particles on a solids basis.

Suitable polyester resins include, for example, those which are sulfonated, non-sulfonated, crystalline, amorphous, combinations thereof and the like. The polyester resins may be linear, branched, crosslinked, combinations thereof and the like. Polyester resins may include those described, for example, in U.S. Pat. Nos. 6,593,049; 6,830,860; 7,754,406; 7,781,138; 7,749,672; and 6,756,176, the disclosure of each of which hereby is incorporated by reference in entirety.

When a mixture is used, such as, amorphous and crystalline polyester resins, the ratio of crystalline polyester resin to amorphous polyester resin may be any suitable or desired range, in embodiments, in the range of from about 1:99 to about 30:70; from about 5:95 to about 25:75; from about 5:95 to about 15:95.

A "polyacid" is a monomer for forming a polyester polymer for toner that comprises at last two reactive acidic groups, such as, a carboxylic acid group, at least three acidic groups or more. Hence, a diacid, a triacid and so on are encompassed by a polyacid.

A "polyol" is a monomer for forming a polyester polymer for toner that comprises at least two reactive hydroxyl groups, such as, an alcohol, at least three hydroxyl groups or more. Hence, a dialcohol or diol, a trialcohol or triol and so on are encompassed by a polyol.

While a reacted monomer per se is not present in a polymer, for the purposes herein, a polymer is defined by the component monomers used to make that polymer. Hence, for a polyester made from a polyol and a polyacid, which during the condensation reaction loses a water molecule for each ester bond, the polymer is said to comprise said polyol and said polyacid. Thus, for example, if 1,2-propanediol and trimellitic acid are reacted to form a polyester, even though technically 1,2-propanediol and trimellitic acid no longer are present in the polyester polymer, herein, the polymer is said to comprise 1,2-propanediol and trimellitic acid.

Amorphous Polyester Resin.

The toner compositions herein include an amorphous polyester resin. In embodiments, the toner compositions comprise a core-shell configuration including an amorphous polyester in the core, the shell or both. In embodiments, the toner compositions comprise a core-shell configuration including an amorphous polyester in the core only. That is, the shell is free of (does not contain) amorphous polyester.

The amorphous polyester resin may be formed by reacting a diol with a diacid in the presence of an optional catalyst. Examples of diacids or diesters including vinyl diacids or vinyl diesters used for the preparation of amorphous polyesters include dicarboxylic acids or diesters such as terephthalic acid, phthalic acid, isophthalic acid, fumaric acid, dimethyl fumarate, dimethyl itaconate, cis-1,4-diacetoxy-2-butene, diethyl fumarate, diethyl maleate, maleic acid, succinic acid, itaconic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethyl-isophthalate, diethylisophthalate, dimethylphthalate, phthalic anyhydride, diethylphthalate, dimethylsuccinate dimethylfumarate, dimethylmaleate, dimethylglutarate, dimethyladipate, dimethyl dodecylsuccinate, and combinations thereof. The organic diacid or diester may be present in any suitable or desired amount, in embodiments, in an amount of from about 40 to about 60 mole percent of the resin, or from about 42 to about 52 mole percent of the resin, or from about 45 to about 50 mole percent of the resin.

Examples of diols which may be used in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The organic diol may be present in any suitable or desired amount, in embodiments, in an amount of from about 40 to about 60 mole percent of the resin, or from about 42 to about 55 mole percent of the resin, or from about 45 to about 53 mole percent of the resin.

Polycondensation catalysts which may be used in forming the amorphous polyester or the optional crystalline polyester include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be used in any suitable or desired amount, in embodiments, in an amount of from about 0.01 mole percent to about 4 mole percent based on the starting diacid or diester used to generate the polyester resin.

In embodiments, suitable amorphous resins include polyesters, polyamides, polyolefins, polyethylene, polybutylene, polyisobutyrate, ethylene-propylene copolymers, ethylene-vinyl acetate copolymers, polypropylene, combinations thereof, and the like.

Examples of amorphous resins which may be used include alkali sulfonated-polyester resins, branched alkali sulfonated-polyester resins, alkali-sulfonated-polyimide resins, and branched alkali sulfonated-polyimide resins. Alkali sulfonated polyester resins may be used, in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium, or potassium ion.

In embodiments, as noted above, an amorphous polyester resin is selected as a latex resin. Examples of such resins include those disclosed in U.S. Pat. No. 6,063,827, which is hereby incorporated by reference herein in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the formula

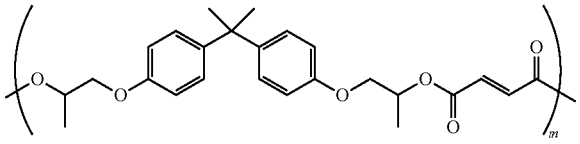

wherein m is from about 5 to about 1,000. Examples of such resins and processes for their production include those disclosed in U.S. Pat. No. 6,063,827.

An example of a linear propoxylated bisphenol A fumarate resin which may be used as a latex resin is available under the trade name SPARII from Resana S/A Industrias Quimicas, Sao Paulo, Brazil. Other propoxylated bisphenol A fumarate resins that may be used and are commercially available include GTUF and FPESL-2 from Kao Corporation, Japan, and EM181635 from Reichhold, Research Triangle Park, N.C., and the like.

Crystalline Polyester Resin.

In embodiments, the toner herein optionally comprises a crystalline polyester resin.

The crystalline polyester resins, which are available from a number of sources, can be prepared by a polycondensation process by reacting an organic diol and an organic diacid in the presence of a polycondensation catalyst. Generally, a stoichiometric equimolar ratio of organic diol and organic diacid is used. However, in some instances, wherein the boiling point of the organic diol is from about 180° C. to about 230° C., an excess amount of diol can be used and removed during the polycondensation process. The amount of catalyst used varies, and can be selected in an amount, for example, of from about 0.01 to about 1 mole percent of the resin. Additionally, in place of the organic diacid, an organic diester can also be selected, where an alcohol by-product is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol is, for example, selected in an amount of from about 45 to about 50 mole percent of the resin, and the alkali sulfo-aliphatic diol can be selected in an amount of from about 1 to about 10 mole percent of the recent.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, and mesaconic acid, a diester or anhydride thereof; and an alkali sulfo-organic diacid such as the sodio, lithio, or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxyisophthalic acid, dialkyl-sulfo-benzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

There can be selected as a third latex a branched amorphous resin such as an alkali sulfonated polyester resin. Examples of suitable alkali sulfonated polyester resins include the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium, or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-co-poly (butylene-adipate), alkali copoly(5-sulfo-isophthaloyl)-copoly(pentylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(oxylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium, or potassium, and the like. In embodiments, the alkali metal is lithium.

The crystalline resin may be present in any suitable or desired amount, in embodiments, in an amount of from about 5 to about 50 percent, or from about 10 to about 35 percent by weight of the toner composition.

In embodiments, the toner is free of, that is, does not contain any crystalline polyester resin. In embodiments, the toner comprises a core-shell configuration wherein both the core and the shell are free of crystalline polyester resin.

In embodiments, the toner comprises a core-shell configuration wherein the core, the shell, or both the core and shell comprise crystalline polyester in a reduced amount of from about 0 to about 4, or from about 2 to about 6, or from about 1 to about 5 percent by weight, in embodiments, in an amount of greater than zero to less than about 4 percent by weight based upon the total weight of the toner composition. In certain embodiments, the core is free of crystalline polyester resin.

The crystalline resin can possess various melting points, of, for example, from about 30° C. to about 120° C., or from about 50° C. to about 90° C. The crystalline resin may have a number average molecular weight (Mn), as measured by gel permeation chromatography (GPC) of, for example, from about 1,000 to about 50,000, or from about 2,000 to about 25,000, and a weight average molecular weight (Mw) of, for example, from about 2,000 to about 100,000, or from about 3,000 to about 80,000, as determined by Gel Permeation Chromatography using polystyrene standards. The molecular weight distribution (Mw/Mn) of the crystalline resin may be, for example, from about 2 to about 6, or from about 3 to about 4.

In embodiments, the crystalline polyester has an onset melting temperature of greater than about 55° C. and an offset melting temperature of less than about 80° C., such that only a single peak is observed in the MDSC of the toner.

Polymeric Resin—Styrene, Acrylate, Styrene-Acrylate Copolymers.

The toner herein optionally includes at least one resin comprising at least one of a styrene monomer, an acrylic acid monomer, an acrylic ester monomer, an acrylate, a styrene-acrylate copolymer, or a combination thereof, and an optional crystalline polyester. In embodiments, the toner resin comprises a first resin comprising an amorphous polyester resin and a second resin comprising a styrene-acrylate resin. In embodiments, the second resin comprises at least one of a styrene monomer, an acrylic acid monomer, an acrylic ester monomer, an acrylate, a styrene-acrylate copolymer, or a combination thereof.

In embodiments, the toner comprises a core-shell configuration. In embodiments, at least one of the core, the shell, or both comprises a wax; the core comprises an amorphous polyester resin and a resin comprising at least one of a styrene, an acrylate, a styrene-acrylate copolymer, or a combination thereof; and the shell comprises a resin comprising at least one of a styrene, an acrylate, or a styrene-acrylate copolymer.

The core resin and the shell resin can be the same or different. In embodiments, the toner comprises at least one styrene acrylate polymer resin. In embodiments, the toner comprises a core-shell configuration comprising at least one styrene acrylate polymer resin in the core, the shell, or both, wherein the styrene acrylate polymer resin is the same or different.

In embodiments, the core resin, the shell resin, or both, may be, independently, styrene-alkyl acrylate, more particularly a styrene-butyl acrylate polymer such as a styrene-butyl acrylate polymer.

In embodiments, the core comprises a styrene-acrylate resin and an amorphous polyester resin; and the shell comprises a styrene-acrylate resin.

In embodiments, the core resin, the shell resin, or both, each include a styrene monomer and an acrylic monomer. In embodiments, the core resin further comprises at least one cross-linker. In embodiments, the shell resin further comprises at least one cross-linker.

While unreacted monomer per se is not present in a polymer, for the purposes herein, a polymer is defined by the component monomers used to make that polymer. Hence, for example, a resin made from a styrene monomer and an acrylate monomer is said to be a styrene-acrylate resin.

In embodiments, the toner has a core-shell configuration; wherein the core comprises a first resin comprising an amorphous polyester resin and a second resin comprising a styrene-acrylate resin; and optionally, a colorant; and wherein the shell comprises a styrene-acrylate resin. In embodiments, the toner has a core-shell configuration, wherein the core comprises the first resin comprising an amorphous polyester resin and the second resin, wherein the second resin is a styrene-acrylate resin, and, optionally, a colorant; and wherein the shell comprises a styrene-acrylate resin.

As used herein, in embodiments, the term "styrene monomer" refers to styrene per se, as well as styrene containing one or more substitutions, such as 3-chlorostyrene, 2,5-dichlorostyrene, 4-bromostyrene, 4-tert-butylstyrene, 4-methoxystyrene and the like.

As used herein, the term "acrylic acid monomer" refers to acrylic acid, methacrylic acid, and β-CEA. As used herein, the term "acrylic ester monomer" refers to esters of acrylic acid and methacrylic acid. Acrylic ester monomers include, but are not limited to, butyl acrylate, butyl methacrylate, propyl acrylate, propyl methacrylate, ethyl acrylate, ethyl methacrylate, methyl acrylate and methyl methacrylate. In certain embodiments, the acrylic ester monomer is n-butyl acrylate.

Illustrative examples of specific polymers for the toner, in embodiments, the core, the shell, or both, include, independently, poly(styrene-acrylic acid), polystyrene-alkyl acrylate), poly(styrene-alkyl methacrylate), poly(styrene-alkyl acrylate-acrylic acid), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methylmethacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar polymers. The alkyl group in the aforementioned polymers may be any alkyl group, and in particular may be a $C_1$-$C_{12}$ alkyl group, for example, including methyl, ethyl, propyl, and butyl. As the aryl group, any aryl group known in the art may be used.

In embodiments, the styrene monomer is present in the core in an amount of from about 30 to about 90, or from about 70 to about 90 weight percent by weight of the core resin.

In embodiments, the acrylic ester monomer is present in the core in an amount of from about 10 to about 70, or from about 10 to about 30 weight percent by weight of the core resin.

In embodiments, the styrene monomer is present in the shell in an amount of from about 30 to about 90, or from about 70 to about 90 weight percent by weight of the shell.

In embodiments, the acrylic ester monomer is present in the shell in an amount of from about 10 to about 70, or from about 10 to about 30 weight percent by weight of the shell.

In embodiments, the core resin includes styrene and n-butyl acrylate.

In embodiments, the shell resin includes styrene and n-butyl acrylate.

In embodiments, the core resin may have a mean particle size of from about 100 nanometers (nm) to about 250 nm, or from about 100 nm to about 140 nm, or from about 140 nm to about 200 nm, or from about 140 to about 250 nm.

In embodiments, the shell resin may have a mean particle size of from about 100 nanometers (nm) to about 250 nm, or from about 100 nm to about 140 nm, or from about 140 nm to about 200 nm, or from about 140 to about 250 nm.

Wax.

The toner compositions herein optionally comprise a wax.

In embodiments, the wax is a paraffin wax. Any suitable or desired paraffin wax can be selected for embodiments herein. In embodiments, the paraffin wax can be selected from the group consisting of BW-422 and BW-436 from Blended Waxes, Inc.; IGI 1245A, IGI 1250A, IGI 1297A, IGI 1266A all from the International Group, Inc.; Indrawax 6062-F, Indrawax 6264-F, Indrawax 6466-F, Indrawax 6668-F, Indrawax 6870-F, Indrawax 7072-F, Indrawax 8070, Indrawax 6062-S 140-144, Indrawax 6062-S all from Industrial Raw Materials LLC, Shell Sarawax SX70 from Alpha Wax, Strahl & Pitsch 434 and 674 paraffin waxes; dispersions of paraffin waxes including CHEMBEAD® 30, CHEMBEAD® 30-AM, PARAFINE 30, PARAFFIN 60, PARAFFIN EMULSION 135-45 FDA, PARAFFIN EMULSION 150-45 FDA, all from BYK Additives & Instruments, and combinations thereof.

The wax, can be provided in the toner at any suitable or desired amount. In embodiments, the wax is provided in an amount of from about 2 to about 4, from about 1 to about 4, or from about 1 to about 9 percent by weight based upon the total weight of the toner composition.

In embodiments, the wax is an ester wax. Any suitable or desired ester wax can be selected for embodiments herein. In embodiments, the ester wax can be selected from the group consisting of montanic acid esters, ethylene glycol fatty acid esters, sorbitol fatty acid esters and polyoxyethylene fatty acid esters, higher fatty acid and higher alcohol esters, such as stearyl stearate and behenyl behenate; higher fatty acid and monovalent or multivalent lower alcohol esters, such as, butyl stearate, propyl oleate, glyceride monostearate, glyceride distearate and pentaerythritol tetra behenate; higher fatty acid and multivalent alcohol multimer esters, such as, diethyleneglycol monostearate, dipropyleneglycol distearate, diglyceryl distearate and triglyceryl tetrastearate; sorbitan higher fatty acid esters, such as, sorbitan monostearate and cholesterol higher fatty acid esters, such as, cholesteryl stearate, triacontanyl palmitate, Licowax F™ available from Clariant Corporation, MP-Wax 5767, 5792, 5793, all available from Chukyo Yushi Co., Ltd.; Ester Wax E, Ester Wax E DAB, Ester Wax GE, Ester Wax ESL, Ester Wax EMS, Ester Wax LCP, Ester Wax LG, Ester Wax LGE, Ester Wax ELE, Ester Wax LA, Ester Wax E 50 all from Strohmeyer & Arpe, FINESTER 2860, FINESTER 2840, FINESTER 2240, FINESTER GMS 4654 V, FINESTER MG 9500, FINESTER MG 9000, FINESTER EG 1020, FINESTER EG 1018, all available from Fine Organics, and combinations thereof.

The ester wax, can be provided in the toner in any suitable or desired amount. In embodiments, the ester wax is provided in an amount of from about 1 to about 4, from about 2 to about 4, or from about 4 to about 8 percent by weight based upon the total weight of the toner composition.

The toner compositions can optionally contain one or more additional waxes. The optional additional wax can be included in the core, the shell, or both. The optional additional wax can include any of the various waxes conventionally used in emulsion aggregation toner compositions. Suitable examples of waxes include polyethylene, polypropylene, polyethylene/amide, polyethylenetetrafluoroethylene, and polyethylenetetrafluoroethylene/amide. Other examples include polyolefin waxes, such as polyethylene waxes, including linear polyethylene waxes and branched polyethylene waxes, and polypropylene waxes, including linear polypropylene waxes and branched polypropylene waxes; paraffin waxes, Fischer-Tropsch waxes, amine waxes; silicone waxes; mercapto waxes; polyester waxes; urethane waxes; modified polyolefin waxes (e.g., a carboxylic acid-terminated polyethylene wax or a carboxylic acid-terminated polypropylene wax); amide waxes, such as aliphatic polar amide functionalized waxes; aliphatic waxes consisting of esters of hydroxylated unsaturated fatty acids; high acid waxes, such as high acid montan waxes; microcrystalline waxes, such as waxes derived from distillation of crude oil; and the like. By "high acid waxes" it is meant a wax material that has a high acid content. The waxes can be crystalline or non-crystalline, as desired, although crystalline waxes are preferred. By "crystalline polymeric waxes" it is meant that a wax material contains an ordered array of polymer chains within a polymer matrix that can be characterized by a crystalline melting point transition temperature, Tm. The crystalline melting temperature is the melting temperature of the crystalline domains of a polymer sample. This is in contrast to the glass transition temperature, Tg, which characterizes the temperature at which polymer chains begin to flow for the amorphous regions within a polymer. In other embodiments, the toner does not contain any additional waxes other than the first wax and second wax described above.

To incorporate the wax into the toner, it is desirable for the wax to be in the form of one or more aqueous emulsions or dispersions of solid wax in water, where the solid wax particle size is usually in the range of from about 100 to about 500 nanometers.

If present, the toners may contain the optional wax in any suitable or desired amount, in embodiments, in an amount of from about 1 to about 13 percent, or from about 3 to about 15 percent, or from about 5 to about 11 percent, by weight of the toner, on a dry basis.

Colorant.

The toners may optionally contain a colorant. Any suitable or desired colorant can be selected. In embodiments, the colorant can be a pigment, a dye, mixtures of pigments and dyes, mixtures of pigments, mixtures of dyes, and the like. For simplicity, the term "colorant" when used herein is meant to encompass such colorants, dyes, pigments, and mixtures unless specified as a particular pigment or other colorant component. In embodiments, the colorant comprises a pigment, a dye, mixtures thereof, in embodiments, carbon black, magnetite, black, cyan, magenta, yellow, red, green, blue, brown, mixtures thereof, in an amount of from about 1 percent to about 25 percent by weight based upon the total weight of the toner composition. It is to be understood that other useful colorants will become readily apparent based on the present disclosure. In embodiments, the colorant comprises a magenta colorant.

Useful colorants include Paliogen® Violet 5100 and 5890 (BASF), Normandy Magenta RD-2400 (Paul Uhlrich), Permanent Violet VT2645 (Paul Uhlrich), Heliogen® Green L8730 (BASF), Argyle Green XP-111-S (Paul Uhlrich), Brilliant Green Toner GR 0991 (Paul Uhlrich), Lithol® Scarlet D3700 (BASF), Toluidine Red (Aldrich), Scarlet for Thermoplast NSD Red (Aldrich), Lithol® Rubine Toner (Paul Uhlrich), Lithol® Scarlet 4440, NBD 3700 (BASF), Bon Red C (Dominion Color), Royal Brilliant Red RD-8192 (Paul Uhlrich), Oracet® Pink RF (Ciba Geigy), Paliogen® Red 3340 and 3871K (BASF), Lithol® Fast Scarlet L4300 (BASF), RE-05 Quinacridone (DIC), Heliogen® Blue D6840, D7080, K7090, K6910, and L7020 (BASF), Sudan Blue OS (BASF), Neopen® Blue FF4012 (BASF), PV Fast Blue B2G01 (American Hoechst), Irgalite® Blue BCA (Ciba Geigy), Paliogen® Blue6470 (BASF), Sudan II, III, and IV (Matheson, Coleman, Bell), Sudan Orange (Aldrich), Sudan Orane 220 (BASF), Paliogen® Orange 3040 (BASF), Ortho Orange OR 2673 (Paul Uhlrich), Paliogen® Yellow 152 and 1560 (BASF), Lithol® Fast Yellow 0991K (BASF), Paliotol® Yellow 1840 (BASF), Novaperm® Yellow FGL (Hoechst), Permanent Yellow YE 0305 (Paul Uhlrich), Lumogen® Yellow 00790 (BASF), Suco-Gelb 1250 (BASF), Suco-Yellow D1355 (BASF), Suco Fast Yellow D1165, D1355, and D1351 (BASF), Hostaperm® Pink E (Hoechst), Fanal® Pink D4830 (BASF), Cinquasia® Magenta (DuPont), Paliogen® BlackL9984 (BASF), Pigment Black K801 (BASF), and particularly carbon blacks such as REGAL® 330 (Cabot), Carbon Black 5250 and 5750 (Columbian Chemicals), and the like, or mixtures thereof.

Additional useful colorants include pigments in water based dispersions such as those commercially available from Sun Chemical, for example, SUNSPERSE® BHD 6011X (Blue 15 Type), SUNSPERSE® BHD 9312X (Pigment Blue 15 74160), SUNSPERSE® BHD 6000X (Pigment Blue 15:3 74160), SUNSPERSE® GHD 9600X and GHD 6004X (Pigment Green 7 74260), SUNSPERSE® QHD 6040 X (Pigment Red 122 73915), SUNSPERSE® RHD 9668X (Pigment Red 185 12516), SUNSPERSE® RHD 9365X and 9504X (Pigment Red 57 15850:1), SUNSPERSE® YHD 6005X (Pigment Yellow 83 21108), FLEXIVERSE® YFD 4249 (Pigment Yellow 17 21105), SUNSPERSE® YHD 6020X and 6045X (Pigment Yellow 74 11741), SUNSPERSE® YHD 600X and 9604X (Pigment Yellow 14 21095), FLEXIVERSE® LFD 4343 and LFD 9736 (Pigment Black 7 77226), and the like, or mixtures thereof. Other useful water based colorant dispersions include those commercially available from Clariant, for example, HOSTAFINE® Yellow GR, HOSTAFINE® Black T and Black TS, HOSTAFINE® Blue B2G, HOSTAFINE® Rubine F6B, and magenta dry pigment such as Toner Magenta 6BVP2213 and Toner Magenta E02 which can be dispersed in water and/or surfactant prior to use.

Other useful colorants include magnetites, such as Mobay magnetites M08029, M98960, Columbian magnetites, MAPICO® BLACKS, and surface treated magnetites; Pfizer magnetites CB4799, CB5300, CB5600, MXC6369, Bayer magnetites, BAYFERROX® 8600, 8610; Northern Pigments magnetites, NP-604, NP-608; Magnox magnetites TMB-100 or TMB-104; and the like or mixtures thereof. Additional examples of pigments include phthalocyanine HELIOGEN® BLUE L6900, D6840, D7080, D7020, PYLAM® OIL BLUE, PYLAM® OIL YELLOW, PIGMENT BLUE 1 available from Paul Uhlrich & Company, Inc., PIGMENT VIOLET 1, PIGMENT RED 48, LEMON CHROME YELLOW DCC 1026, ED. TOLUIDINE RED, AND BON RED C available from Dominion Color Corporation, Ltd., Toronto, Ontario, NOVAPERM® YELLOW FGL, HOSTAPERM® PINK E from Hoechst, and CINQUASIA® MAGENTA (DuPont), and the like. Examples of magentas include 2,9-dimethyl substituted quinacridone and anthraquinone dye identified in the Color Index as CI 60710, CI Dispersed Red 15, diazo dye identified in the Color Index as CI 26050, CI Solvent Red 19, and the like, or mixtures thereof. Examples of cyans include copper tetra(octadecyl sulfonamide) phthalocyanine, x-copper phthalocyanine pigment listed in the Color Index as CI 74160, CI Pigment Blue, and Anthrathrene Blue identified in the Color Index as DI 69810, Special Blue X-2137, and the like, or mixtures thereof. Illustrative examples of yellows that may be selected include diarylide yellow 3,3-dichlorobenzidene acetoacetanilides, a monoazo pigment identified in the Color Index ad CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,4-dimethoxy acetoacetanilide, and Permanent Yellow FGL. Colored magnetites, such as mixtures of MAPICO® BLACK and cyan components may also be selected as pigments.

The colorant, such as carbon black, cyan, magenta, and/or yellow colorant, is incorporated in an amount sufficient to impart the desired color to the toner. In general, pigment or dye is employed in an amount of from about 1 percent to about 35 percent, or from about 5 percent to about 25 percent, or from about 5 percent to about 15 percent, by weight of the toner particles on a solids basis. However, amounts outside of these ranges can also be used.

In embodiments, the total solids loading (total amount of all solids in the toner process) is from about 10 to about 14 percent.

Optional Additives.

The toner particles can also contain other optional additives as desired. For example, the toner can include positive or negative charge control agents in any desired or effective amount, in embodiments, in an amount of at least about 0.1 percent by weight of the toner, or at least about 1 percent by weight or the toner, or no more than about 10 percent by weight of the toner, or no more than about 3 percent by weight of the toner. Examples of suitable charge control agents include, but are not limited to, quaternary ammonium compounds such as alkyl pyridinium halides, bisulfates, alkyl pyridinium compounds, including those disclosed in U.S. Pat. No. 4,298,672, which is hereby incorporated by reference herein in its entirety; organic sulfate and sulfonate compositions, including those disclosed in U.S. Pat. No. 4,338,390, which is hereby incorporated by reference herein in its entirety; cetylpyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in embodiments, in an amount of at least about 0.1 percent by weight of the toner, or at least about 0.25 percent by weight of the toner, or no more than about 5 percent by weight of the toner, or no more than about 3 percent by weight of the toner. Suitable additives include, but are not limited to, those disclosed in U.S. Pat. Nos. 3,590,000 and 6,214,507, each of which are hereby incorporated by reference herein in their entireties. These additives can be applied simultaneously with the shell resin or after application of the shell resin.

Coagulant.

The toners herein may also contain a coagulant, such as a monovalent metal coagulant, a divalent metal coagulant, a polyion coagulant, or the like. A variety of coagulants are known in the art. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds, in embodiments, may have from about 2 to about 13, or from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from about 0 to about 5 percent, or from about greater than 0 to about 3 percent, by weight of the toner particles.

Surfactant.

In preparing the toner by the emulsion aggregation procedure, one or more surfactants may be used in the process. Suitable surfactants include anionic, cationic, and non-ionic surfactants. In embodiments, the use of anionic and non-ionic surfactants are preferred to help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl sulfates and sulfonates, abietic acid, and the NEOGEN® brand of anionic surfactants. An example of a suitable anionic surfactant is NEOGEN® RK available from Daiichi Kogyo Seiyaku co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, ethyl pyridinium bromide, C12, C15, C17 trimethyl ammonium bromides, halide salts of quaternized polyoxyethylalkylamines, dodecyl benzyl triethyl ammonium chloride. MIRAPOL® and ALKAQUAT® available from Alkaril Chemical Company, SANISOL® (benzalkonium chloride) available from Kao Chemicals, and the like. An example of a suitable cationic surfactant is SANISOL® B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxytheylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL® CA-210, IGEPAL® CA-520, IGEPAL® CA-720, IGEPAL® CO-890, IGEPAL® CO-720, IGEPAL® CO-290, IGEPAL® CA-210, ANTAROX® 890 and ANTAROX® 897. An example of a suitable nonionic surfactant is ANTAROX® 897 available from Rhone-Poulenc Inc., which consists primarily of alkyl phenol ethoxylate.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide, and the like, among others.

Examples of the acids that can be used include, for example, nitric acid, sulfuric acid, hydrochloric acid, acetic acid, citric acid, trifluro acetic acid, succinic acid, salicylic acid, and the like, and which acids are, in embodiments, used in a diluted form in the range of about 0.5 to about 10 weight percent by weight of water, or in the range of about 0.7 to about 5 weight percent by weight of water.

In embodiments, a naphthalene sulphonic acid polymeric surfactant is selected.

Process.

The toner process herein is, in embodiments, an emulsion aggregation process for forming the emulsion aggregation toner particles. The process may include aggregating an emulsion containing polymer binder (that is, for example, a first latex including an amorphous polyester and optionally at least one of a styrene, an acrylate, or a combination thereof, an optional crystalline polyester latex), an optional colorant, an optional wax, an optional surfactant, an optional coagulant, a first chelating agent and a second chelating agent, and any optional additives to form aggregates of core particles, and subsequently preparing a shell mixture which includes mixing the desired coalescent agent and a second latex to form a shell mixture; coating the shell mixture onto the aggregated core particles, subsequently coalescing or fusing the aggregates, and then recovering, optionally washing, optionally cooling, optionally drying, the obtained emulsion aggregation toner particles, and optionally isolating the toner particles.

As described herein, the first chelating agent and the second chelating agent may be added at any suitable or desired time in the emulsion aggregation process. In embodiments, the first chelating agent and the second chelating agent are added during the coalescing step. In embodiments, the first chelating agent and the second chelating agent are added during the freezing step.

In embodiments, a toner process herein comprises a) mixing reagents comprising at least one amorphous resin, an optional crystalline resin, an optional styrene, acrylate or styrene/acrylate, an optional wax, an optional colorant to form an emulsion comprising a resin particle; b) adding at least one aggregating agent and aggregating said resin particle to form a nascent toner particle; c) optionally, adding one or more resins to form a shell on said nascent toner particle to yield a core-shell particle; d) adding a first chelating agent and a second chelating agent; wherein said first chelating agent and said second chelating agent are different; e) freezing particle growth to form an aggregated toner particle; f) coalescing said aggregated toner particle to form a toner particle; and g) optionally, collecting said toner particle.

Aggregating may be performed at any suitable or desired temperature. In embodiments, aggregating step b) is performed at a temperature of from about 40 to about 50° C.

Freezing may be performed at any suitable or desired temperature. In embodiments, freezing step e) is performed at a temperature of from about 40 to about 50° C.

In embodiments, the mixing of the first latex, the optional wax, optional colorant, and optional coagulant, results in a core mixture having a pH of, for example, about 7.0 to about 8.5 that is adjusted to a pH of about 4.0 to about 5.0 with dilute acid (for example, 0.3 molar nitric acid), which is aggregated by heating to a temperature below the polymer Tg to provide toner size aggregates. In embodiments, the heating of the core mixture may be conducted at a temperature of from about 40 to about 60° C., or from about 45 to about 50° C., or from about 40 to about 55° C. In embodiments, the core mixture may be heated for from about 15 minutes to about 120 minutes, or from about 15 minutes to about 60 minutes, or from about 15 minutes to about 30 minutes.

A second latex may then be mixed with a coalescent agent to form a shell mixture. The pH of the shell mixture may then be adjusted, for example by the addition of a dilute acid, such as nitric acid solution, or the like, until a pH of about 3.0 to about 6.0 is achieved. The resulting shell mixture may be coated onto the surface of the aggregated core particles thus providing a shell over the formed aggregates. Subsequently, the shell mixture and the aggregated core particles may be heated to a temperature above the glass transition of any of the shell resin polymers, such as the at least one styrene-acrylate resin, to coalesce the aggregated core particles to form toner particles. In embodiments, the heating of the shell mixture and the aggregated core particles may be conducted at a temperature of from about 65 to about 90° C., or from about 70 to about 85° C., or from about 75 to about 85° C.

In embodiments, the shell mixture and the aggregated core particles may be heated for from about 15 minutes to about 480 minutes, or from about 30 minutes to about 360 minutes, or from about 90 minutes to about 480 minutes.

The coalesced particles can be measured for shape factor or circularity, such as with a Sysmex FPIA 3000 analyzer, until the desired shape is achieved.

The resulting toner particles may be allowed to cool to room temperature (about 20° C. to about 25° C.) which may be rapidly cooled by using a quenching technique well known in the art, and are optionally washed to remove any additive or surfactant. The toner particles are then optionally dried.

In prior toner processes, after two shell additions the reaction is heated to no higher than about 47 to about 48° C. to enable low aluminum levels. When the toner particle size reaches about 4.5 to about 4.7 micrometers, freezing begins with the pH of the slurry adjusted to about 4.5 using a 4% NaOH solution. This is then often followed by the addition of EDTA and additional NaOH solution until the pH reaches about 7.8. The temperature is then ramped to coalescence while maintaining the pH at about 7.8 using 4% NaOH.

In the process of the present disclosure, both a first chelating agent and a second chelating agent that is different from the first chelating agent, in embodiments, wherein the first and second chelating agents possess different abilities to extract metal from the toner particle, are added during the emulsion aggregation toner process. In certain embodiments, both the first chelating agent and the second chelating agent are added during freezing. In further embodiments, the first chelating agent is added first, and the second chelating agent is added second. In still further embodiments, the first chelating agent and the second chelating agent are added during the freezing step, with the first chelating agent being added first and the second chelating agent being added second.

In certain specific embodiments, the first chelating agent is EDTA and the second chelating agent is HIDS. In embodiments, the EDTA and HIDS are added during freezing. In certain embodiments, the EDTA is added first and the HIDS is added second. In specific embodiments, the EDTA and HIDS are added during freezing, with the EDTA added first and the HIDS added second. This is followed, in embodiments, but adjusting the pH, such as by using a NaOH solution to reach a desired pH, such as a pH of about 7.8.

In embodiments, after a single shell addition, the reaction is heated, such as to a temperature of about 48° C. When the toner particle size reaches a desired size, such as about 4.5 to about 4.7 micrometers, freezing begins, such as with adjustment of the pH of the slurry by any suitable or desired means to any suitable or desired pH, such as with the pH of the slurry being adjusted to about 4.8 using a 4% NaOH solution. This is followed by the addition of the first and second chelating agents, in embodiments, by the addition of EDTA and HIDS. The pH is then further adjusted, such as by addition of NaOH solution until the pH reaches a desired pH, such as a pH of about 8.7. The temperature is then ramped to coalescence while maintain the pH, such as while maintaining the pH at about 8.7 using 4% NaOH.

In embodiments, a toner herein comprises at least one amorphous resin, an optional crystalline resin, an optional styrene, acrylate or styrene/acrylate, an optional wax, and an optional colorant; wherein the toner is formed using a first chelating agent and a second chelating agent; wherein said first chelating agent and said second chelating agent are different; wherein said first chelating agent has a first ability to remove metal from the toner particle; wherein said second chelating agent has a second ability to remove metal from the toner particle; and wherein said first ability to remove metal from the toner particle and said second ability to remove metal from the toner particle are different.

Gloss.

The gloss of a toner may be influenced by the amount of retained metal ion, such as, $Al^{3+}$, in a particle. The amount of retained metal ion may be adjusted further by the addition of a chelating agent, such as, EDTA. In embodiments, the amount of retained catalyst, for example, Al3 in toner particles of the present disclosure may be about 500 ppm or less, about 450 ppm or less, or about 400 ppm or less. In embodiments, the residual aluminum level is about 350 to about 450 ppm. The gloss level of a toner of the instant disclosure may have a gloss, as measured by Gardner gloss units (gu), of from about 10 gu to about 70 gu, from about 15 gu to about 65 gu, from about 20 gu to about 60 gu.

Use of the chelating agent reduces retained metal ion content, thereby increasing gloss of the final image.

In the toners prepared by the present toner process, a combination of a first chelating agent and a second chelating agent that is different from the first chelating agent, each having a differing ability to extract aluminum from the toner particle, is employed. In embodiments, the process herein enables higher aluminum enabling desired gloss, in embodiments, enabling a gloss of from about 15 to about 60 gu.

In embodiments, the formed toner particle of f), when disposed on to a substrate to form an image at a toner mass area of about 0.25 to about 0.62 $mg/cm^2$, and fused to the substrate, provides said image having a gloss of from about 15 gu to about 60 gu.

Developers.

The toner particles thus formed may be formulated into a developer composition. For example, the toner particles may be mixed with carrier particles to achieve a two component developer composition. The toner concentration in the developer may be from about 1% to about 25% by weight of the total weight of the developer, from about 2% to about 15% by weight of the total weight of the developer, with the remainder of the developer composition being the carrier. However, different toner and carrier percentages may be used to achieve a developer composition with desired characteristics.

Examples of carrier particles for mixing with the toner particles include those particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

In embodiments, the carrier particles may include a core with a coating thereover, which may be formed from a polymer or a mixture of polymers that are not in close proximity thereto in the triboelectric series, such as, those as taught herein or as known in the art. The coating may include fluoropolymers, such as, polyvinylidene fluorides, terpolymers of styrene, methyl methacrylates, silanes, such as triethoxy silanes, tetrafluoroethylenes, other known coatings and the like. For example, coatings containing polyvinylidenefluoride, available, for example, as KYNAR 301™, and/or polymethylmethacrylate (PMMA), for example, having a weight average molecular weight of about 300,000 to about 350,000, such as, commercially available from Soken, may be used. In embodiments, PMMA and polyvinylidenefluoride may be mixed in proportions of from about 30 to about 70 wt % to about 70 to about 30 wt %, from about 40 to about 60 wt % to about 60 to about 40 wt %. The coating may have a coating weight of, for example, from about 0.1 to about 5% by weight of the carrier, from about 0.5 to about 2% by weight of the carrier.

Various effective suitable means may be used to apply the polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt and to fuse to the carrier core. The coated carrier particles then may be cooled and thereafter classified to a desired particle size.

The carrier particles may be prepared by mixing the carrier core with polymer in an amount from about 0.05 to about 10% by weight, from about 0.01 to about 3% by weight, based on the weight of the coated carrier particle, until adherence thereof to the carrier core is obtained, for example, by mechanical impaction and/or electrostatic attraction.

In embodiments, suitable carriers may include a steel core, for example, of from about 25 to about 100 μm in size, from about 50 to about 75 μm in size, coated with about 0.5% to about 10% by weight, from about 0.7% to about 5% by weight of a polymer mixture including, for example, methylacrylate and carbon black, using the process described, for example, in U.S. Pat. Nos. 5,236,629 and 5,330,874.

Devices Comprising A Toner Particle.

Toners and developers may be combined with a number of devices ranging from enclosures or vessels, such as, a vial, a bottle, a flexible container, such as a bag or a package, and so on, to devices that serve more than a storage function.

The toner compositions and developers of interest may be incorporated into devices dedicated, for example, to delivering same for a purpose, such as, forming an image. Hence, particularized toner delivery devices are known, see, for example, U.S. Pat. No. 7,822,370, and may contain a toner preparation or developer of interest. Such devices include cartridges, tanks, reservoirs and the like, and may be replaceable, disposable or reusable. Such a device may comprise a storage portion; a dispensing or delivery portion; and so on; along with various ports or openings to enable toner or developer addition to and removal from the device; an optional portion for monitoring amount of toner or developer in the device; formed or shaped portions to enable siting and seating of the device in, for example, an imaging device: and so on.

A toner or developer of interest may be included in a device dedicated to delivery thereof, for example, for recharging or refilling toner or developer in an imaging device component, such as, a cartridge, in need of toner or developer, see, for example, U.S. Pat. No. 7,817,944, wherein the imaging device component may be replaceable or reusable. See also U.S. Pat. No. 9,612,549, which is hereby incorporated by reference herein in its entirety, describing a cartridge with a black toner of reduced dielectric loss and improved tribo charging.

In embodiments, a is a toner cartridge herein comprises a storage portion and a delivery portion, said cartridge comprising a toner prepared by a process comprising a) mixing reagents comprising at least one amorphous resin, an optional crystalline resin, an optional styrene, acrylate or styrene/acrylate, an optional wax, an optional colorant to form an emulsion comprising a resin particle; b) adding at least one aggregating agent and aggregating said resin particle to form a nascent toner particle; c) optionally, adding one or more resins to form a shell on said nascent toner particle to yield a core-shell particle; d) adding a first chelating agent and a second chelating agent; wherein said first chelating agent and said second chelating agent are different; e) freezing particle growth to form an aggregated toner particle; f) coalescing said aggregated toner particle to form a toner particle; and g) optionally, collecting said toner particle.

The toners or developers may be used for electrostatographic or electrophotographic processes, including those disclosed in U.S. Pat. No. 4,295,990, the disclosure of which hereby is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Styrene Latex 1. A styrene-n-butylacrylate copolymer latex with a styrene:n-butylacrylate monomer ratio of 3.29 was prepared at the 300-gallon scale using emulsion polymerization. The final latex possessed a Tg ($2^{nd}$ onset) of 59.2° C., a molecular weight (Mw) of 48 000 g/mol, a particle size of 87 nm and a solids of approximately 39%.

Crystalline Polyester Latex 1. A poly(1,6-hexylene-1,12 dodecanoate) crystalline polyester (with an acid value of 6.85 mg KOH/g and a viscosity of 93.9 centipoise (cP)) was prepared by a solvent-free phase inversion emulsification process made with 2 percent by weight triethanolamine and 4 percent by weight Tayca Power BN2060 to obtain a particle size of about 200 nm and a solids of about 40%.

Crystalline Polyester Latex 2. Crystalline Polyester Latex 2 was prepared as for Crystalline Polyester Latex 1 except that 5% of Tayca Power BN2060 was used and the particle size was 220 nm at a solids of about 40%.

Amorphous Polyester Latex 1. Amorphous Polyester Latex 1 was prepared from an amorphous polyester resin in an emulsion having an Mw of about 19,400, an Mn of about 5,000, a Tg onset of about 60° C., particle size approximately 170-230 nm and about 35% solids of composition terpoly-(propoxylated bisphenol A-terephthalate) terpoly-(propoxylated bisphenol A-dodecenylsuccinate) terpoly-(propoxylated bisphenol A fumarate).

Amorphous Polyester Latex 2. Amorphous Polyester Latex 2 was prepared from an amorphous polyester resin in an emulsion, having an average molecular weight (Mw) of about 86,000, a number average molecular weight (Mn) of about 5,600, an onset glass transition temperature (Tg onset) of about 56° C., particle size approximately 70 nm and about 35% solids of composition terpoly-(propoxylated bisphenol A-terephthalate) terpoly-(propoxylated bisphenol A-dodecenylsuccinate) terpoly-(propoxylated bisphenol A fumarate).

Amorphous Polyester Latex 3. Amorphous Polyester Latex 3 was prepared from an amorphous polyester resin in an emulsion, having an average molecular weight (Mw) of about 86,000, a number average molecular weight (Mn) of about 5,600, an onset glass transition temperature (Tg onset) of about 56° C., particle size approximately 70 nm and about 35% solids of composition terpoly-(propoxylated bisphenol A-terephthalate) terpoly-(propoxylated bisphenol A-dodecenylsuccinate) terpoly-(propoxylated bisphenol A fumarate).

Example 1

Toner process according to the present disclosure. In a 2 Liter glass reactor, the following components were combined: 74.98 grams Amorphous Polyester Latex 1 made from an amorphous polyester resin in an emulsion having an Mw of about 19,400, an Mn of about 5,000, a Tg onset of about 60° C., particle size approximately 170-230 nm and about 35% solids of composition terpoly-(propoxylated bisphenol A-terephthalate) terpoly-(propoxylated bisphenol A-dodecenylsuccinate) terpoly-(propoxylated bisphenol A fumarate), 90.23 grams Amorphous Polyester Latex 3 made from an amorphous polyester resin in an emulsion, having an average molecular weight (Mw) of about 86,000, a number average molecular weight (Mn) of about 5,600, an onset glass transition temperature (Tg onset) of about 56° C., particle size approximately 70 nm and about 35% solids of composition terpoly-(propoxylated bisphenol A-terephthalate) terpoly-(propoxylated bisphenol A-dodecenylsuccinate) terpoly-(propoxylated bisphenol A fumarate), 7.85 grams Styrene-acrylate Latex 1 prepared using emulsion polymerization at the 300-gallon scale having a Tg (2nd onset) of 59.2° C., a molecular weight (Mw) of 48 000 g/mol, a particle size of 87 nm and a solids of approximately 39%, 46.26 grams Crystalline Polyester Latex 1 (as described above), 35.88 grams polyethylene wax in emulsion having a Tm of about 90° C. and about 30% solids; 32.04 grams RE-05 (Quinacridone magenta pigment, available from DIC), 74.18 grams Pigment Red 269 (magenta pigment, available from Sun Chemical), 0.40 gram sodium arylsulfonate formaldehyde condensate (Demol SN-B, available from Kao Chemicals), and 605.90 grams deionized water. Subsequently, the pH was adjusted from 8.00 to 4.20 with 33.83 grams of 0.3M nitric acid. Thereafter, about 37.85 grams of a flocculent mixture containing about 2.84 grams aluminum sulfate and about 35.00 grams of deionized water was added to the slurry under homogenization about 3,000 to 4,000 rpm (revolutions per minute). Thereafter, the mixture was stirred with one P4 shaft at about 350 rpm and heated at a 1° C. per minute temperature increase to a temperature of about 48° C. A first shell of 22.00 grams Amorphous Polyester Latex 1 made from an amorphous polyester resin in an emulsion having an Mw of about 19,400, an Mn of about 5,000, a Tg onset of about 60° C., a particle size of approximately 170-230 nm and about 35% solids of composition terpoly-(propoxylated bisphenol A-terephthalate) terpoly-(propoxylated bisphenol A-dodecenylsuccinate) terpoly-(propoxylated bisphenol A fumarate), 26.47 grams of Amorphous Polyester Latex 3 made from an amorphous polyester resin in an emulsion, having an average molecular weight (Mw) of about 86,000, a number average molecular weight (Mn) of about 5,600, an onset glass transition temperature (Tg onset) of about 56° C., a particle size of approximately 70 nm and about 35% solids of composition terpoly-(propoxylated bisphenol A-terephthalate) terpoly-(propoxylated bisphenol A-dodecenylsuccinate) terpoly-(propoxylated bisphenol A fumarate) and 10.25 g grams polyethylene wax in emulsion having a Tm of about 90° C. and about 30% solids was added to the reactor, after which the pH was adjusted from pH 7.85 to pH 6.00 with 3.50 grams 0.3M nitric acid. This results in particles having a volume average particle diameter of about 4.0 to about 4.5 micrometers as measured with a Coulter Counter. A second shell of 25.67 g Amorphous Polyester Latex 1 and 30.89 g Amorphous Polyester Latex 3 was then added, after which the pH was adjusted from pH 7.75 to pH 6.00 with 3.79 grams 0.3M nitric acid. This results in particles having a volume average particle diameter of about 4.3 to about 4.6 micrometers as measured with a Coulter Counter. The pH of the reactor mixture was adjusted to about 4.5 with a 4% sodium hydroxide solution, followed by the addition of about 4.04 grams of Versene™ 100 (ethylene diamine tetra acetic acid (EDTA) chelating agent) and 1.14 grams hydroxyl-2,2'iminodisuccinic acid (HIDS, chelating agent). The pH of the reactor mixture was then adjusted to about 7.8 with a 4% sodium hydroxide solution, and the stirring reduced to about 180 rpm. The reactor mixture was then heated at a temperature increase of about 1° C. per minute to a temperature of about 84° C. while maintaining the pH at 7.8 using 4% sodium hydroxide solution. The pH of the mixture was then gradually adjusted to about 7.00 with a sodium acetate buffer solution. The reactor mixture was then gently stirred at about 84° C. for about 2-4 hours to coalesce and spherodize the particles. The mixer is then discharged and quenched with deionized ice and maintained at a slurry temperature to 40° C. and below while sifting using a 25 micrometer sieve. The toner of this mixture had a volume average particle diameter of about 4.3 to about 4.9 micrometers, a geometric size distribution (GSD) of about 1.20, and a circularity of about 0.980. The particles were washed 3 times with deionized water at room temperature and then dried using the freeze dryer.

Example 2

Example 2 was prepared in the manner of Example 1 with the exception that Amorphous Polyester Latex 2 is used instead of Amorphous Polyester Latex 3. The amount of RE-05 Quinacridone magenta pigment was decreased from 3.10 percent to 2.55 percent by weight based on total weight of reagents, and the amount of Pigment Red 269 was decreased from 7.30 percent to 5.96 percent by weight based on total weight of reagents. The slurry pH before aggregation was increased from pH 4.2 to pH 4.8. There is only a single shell with no wax in the shell. The shell latex pH was decreased from pH 6.0 to pH 3.8. The pH at which the chelating agents were added is increased from pH 4.5 to pH 4.8. The final freeze pH is increased from pH 7.8 to pH 8.7.

Example 3

Example 3 was prepared in the manner of Example 2 with the exception that 0.56% by weight EDTA is used versus 1.05% by weight EDTA in Example 2.

Example 4

Example 4 was prepared in the manner of Example 2 with the exception that 0.56% by weight EDTA is used versus 1.05% by weight EDTA in Example 2. Additionally, Crystalline Polyester Latex 2 was used instead of Crystalline Polyester Latex 1.

Comparative Example 5

In a 2 Liter glass reactor, the following components were combined: 75.38 grams Amorphous Polyester Latex 1 made of an amorphous polyester resin in an emulsion having an Mw of about 19,400, an Mn of about 5,000, a Tg onset of about 60° C., a particle size of approximately 170-230 nm and about 35% solids of composition terpoly-(propoxylated bisphenol A-terephthalate) terpoly-(propoxylated bisphenol A-dodecenylsuccinate) terpoly-(propoxylated bisphenol A fumarate), 90.60 grams of Amorphous Polyester Latex 3 made of an amorphous polyester resin in an emulsion, having an average molecular weight (Mw) of about 86,000, a number average molecular weight (Mn) of about 5,600, an onset glass transition temperature (Tg onset) of about 56° C., a particle size of approximately 70 nm and about 35% solids of composition terpoly-(propoxylated bisphenol A-terephthalate) terpoly-(propoxylated bisphenol A-dodecenylsuccinate) terpoly-(propoxylated bisphenol A fumarate), 7.85 grams Styrene-acrylate Latex 1 prepared using emulsion polymerization at the 300-gallon scale having a Tg (2nd onset) of 59.2° C., a molecular weight (Mw) of 48 000 g/mol, a particle size of 87 nm and a solids of approximately 39%, 45.60 grams Crystalline Polyester Latex 1 (as described above), 35.88 grams polyethylene wax in emulsion, having a Tm of about 90° C. and about 30% solids, 32.04 grams RE-05 (Quinacridone magenta pigment, available from DIC), 76.61 grams Pigment Red 269 (magenta pigment, available from Sun Chemical), 0.40 grams sodium arylsulfonate formaldehyde condensate (Demol SN-B, available from Kao Chemicals), and 602.70 grams deionized water. Subsequently, the pH was adjusted from 8.12 to 4.20 with 34.38 grams of 0.3M nitric acid. Thereafter, about 37.85 grams of a flocculent mixture containing about 2.84 grams aluminum sulfate and about 35.01 grams of deionized water was added to the slurry under homogenization at about 3,000 to about 4,200 rpm. Thereafter, the mixture was stirred with one P4 shaft about 400 rpm and heated at a 1° C. per minute temperature increase to a temperature of about 47° C. The first shell of 22.11 grams Amorphous Polyester Latex 1 of an amorphous polyester resin in an emulsion having an Mw of about 19,400, an Mn of about 5,000, a Tg onset of about 60° C., a particle size of approximately 170-230 nm and about 35% solids of composition terpoly-(propoxylated bisphenol A-terephthalate) terpoly-(propoxylated bisphenol A-dodecenylsuccinate) terpoly-(propoxylated bisphenol A fumarate), 26.58 grams Amorphous Polyester Latex 3 of an amorphous polyester resin in an emulsion, having an average molecular weight (Mw) of about 86,000, a number average molecular weight (Mn) of about 5,600, an onset glass transition temperature (Tg onset) of about 56° C., a particle size of approximately 70 nm and about 35% solids of composition terpoly-(propoxylated bisphenol A-terephthalate) terpoly-(propoxylated bisphenol A-dodecenylsuccinate) terpoly-(propoxylated bisphenol A fumarate), and 10.25 grams polyethylene wax in emulsion, having a Tm of about 90° C. and about 30% solids was added to the reactor, after which the pH was adjusted from pH 7.82 to 6.00 with 3.44 grams 0.3 M nitric acid. This results in particles having a volume average particle diameter of about 4.0 to about 4.5 micrometers as measured with a Coulter Counter. The second shell of 25.80 grams of an amorphous polyester resin in an emulsion having an Mw of about 19,400, an Mn of about 5,000, a Tg onset of about 60° C., and about 35% solids of composition terpoly-(propoxylated bisphenol A-terephthalate) terpoly-(propoxylated bisphenol A-dodecenylsuccinate) terpoly-(propoxylated bisphenol A fumarate), low molecular weight amorphous polyester) and 31.01 grams of an amorphous polyester resin in an emulsion, having an average molecular weight (Mw) of about 86,000, a number average molecular weight (Mn) of about 5,600, an onset glass transition temperature (Tg onset) of about 56° C., and about 35% solids of composition terpoly-(propoxylated bisphenol A-terephthalate) terpoly-(propoxylated bisphenol A-dodecenylsuccinate) terpoly-(propoxylated bisphenol A fumarate), high molecular weight amorphous polyester) was added to the reactor, after which the pH was adjusted from pH 7.81 to 6.00 with 4.09 grams 0.3 M nitric acid. This results in particles having a volume average particle diameter of about 4.5 to about 4.7 micrometers as measured with a Coulter Counter. Thus, in embodiments, the toner particle of f) has a volume average particle diameter of from about 4 to about 5 micrometers. The pH of the reactor mixture was adjusted to about 4.5 with a 4% sodium hydroxide solution, followed by the addition of about 5.77 grams of Versene™ 100 (ethylene diamine tetra acetic acid (EDTA) chelating agent). The pH of the reactor mixture was then adjusted to about 7.8 with a 4% sodium hydroxide solution, and the stirring reduced to about 180 rpm. The reactor mixture was then heated at a temperature increase of about 1° C. to a temperature of about 84° C. while maintaining the pH at 7.8 using 4% sodium hydroxide solution. The pH of the mixture was then gradually adjusted to about 7.10 with a sodium acetate buffer solution. The reactor mixture was then gently stirred at about 84° C. for about 2 hours to coalesce and spherodize the particles. The mixer is then discharged and quenched with deionized ice and maintained at a slurry temperature of 40° C. and below while sifting using a 25 micrometer screen. The toner of this mixture had a volume average particle diameter of about 4.3 to about 4.9 micrometers, a geometric size distribution (GSD) of about 1.20, and a circularity of about 0.980. The particles were washed 3 times with deionized water at room temperature and then dried using the freeze dryer.

TABLE 1

| | Ex. 1 | Ex. 2 | Ex. 3 | Ex. 4 | Comparative Ex. 5 |
|---|---|---|---|---|---|
| Slurry pH before aggregant | 4.2 | 4.8 | 4.8 | 4.8 | 4.2 |
| Shell latex pH | 6.0 | 3.8 | 3.8 | 3.8 | 6.0 |
| Wax in Shell (% by weight) | 2% | 0% | 0% | 0% | 2% |
| Freeze Temperature | 47.5° C. | 48.3° C. | 48.4° C. | 48.3° C. | 47.8° C. |
| pH EDTA added | 4.5 | 4.8 | 4.8 | 4.8 | 4.5 |
| EDTA Versene ™ (pph) | 1.05 | 1.05 | 0.56 | 0.56 | 1.5 |
| HIDS (pph) | 0.45 | 0.45 | 0.45 | 0.45 | 0 |
| Final Freeze pH | 7.8 | 8.7 | 8.7 | 8.7 | 7.8 |

TABLE 1-continued

| | Ex. 1 | Ex. 2 | Ex. 3 | Ex. 4 | Comparative Ex. 5 |
|---|---|---|---|---|---|
| Coalescence Temperature | 84° C. | 84° C. | 84° C. | 84° C. | 84° C. |
| Final Coalescence pH | 7.07 | 7.40 | 7.40 | 7.29 | 7.20 |
| Spherodization time (minutes) | 223 | 115 | 120 | 120 | 125 |
| Wet $D_{50v}$ | 4.44 | 4.49 | 4.63 | 4.63 | 4.44 |
| GSDv | 1.23 | 1.22 | 1.22 | 1.22 | 1.19 |
| GSDn | 1.22 | 1.26 | 1.26 | 1.25 | 1.22 |
| Circularity | 0.975 | 0.982 | 0.973 | 0.980 | 0.981 |
| Residual Aluminum (ppm) | 152.9 | 181.3 | 364.6 | 365.9 | 82.55 |

Bench charging evaluation was performed as follows. Bench charge was obtained for parent toner by weighing the toner at 6% TC with 30 grams standard carrier at 30 gram scale. For the blended toner EA toner, a 10 L Henschel blend was done with a known additive package comprising silicas, surface treated titanium and polytetrafluoroethylene in certain amounts. After conditioning samples a minimum of 48 hours for J Zone (about 21.1° C. and 10% relative humidity (RH)), and a minimum 24 hours for A Zone (about 28° C. and 85% RH), the developers were charged in a Turbula mixer 10 minutes for parent developer and 10 minutes and 60 minutes for the blended toner with additives. The toner charge was measured in the form of q/d, the charge to diameter ratio. The q/d was measured using a charge spectrograph visually as the midpoint of the toner charge distribution. The charge was reported in millimeters (mm) of displacement from the zero line. The final mm displacement can be converted to femtocoulombs/micron (fC/μm) by multiplying by 0.092.

The toner charge per mass ratio (Q/M) was also determined by the total blow-off charge method, measuring the charge on a faraday cage containing the developer after removing the toner by blow-off in a stream of air. The total charge collected in the cage is divided by the mas of toner removed by the blow-off, by weighing the cage before and after blow-off to give the Q/M ratio. Good charging performance was observed for all toners of the present disclosure compared to the Comparative Example. With the exception of Example 1, the parent charge was equal or lower than the Comparative Example 5.

Bench charging evaluation is summarized in Table 2.

Fusing evaluation. The samples submitted for fusing evaluation were blended with additives (silica and titania) to improve flow and charging using the SKM mill (about 12,000 rpm for 30 seconds).

Toner was then placed into a modified Xerox® Color 560 printer to generate unfused images. These were a simple square target placed in the center of the page with a TMA (toner mass per unit area) of 0.62 mg/cm$^2$ of toner on Xerox® Bold 90 gsm, uncoated paper (P/N 3R11540) and used for gloss, crease, and hot offset measurements. Gloss/crease targets were a square image placed in the centre of the page. In general, two to four passes through the Xerox® Color 560 printer are required while adjusting the bias and/or the copier lightness setting to achieve the desired TMA. Fusing results for the experimental samples were compared to a commercial cyan control toner.

Samples were then fused with an oil-less fusing fixture, consisting of a Xerox 700 production fuser CRU that was fitted with an external motor and temperature control along with paper transports. Process speed of the fuser was set to 308.7 mm/s (nip dwell of ~27 ms) and the fuser roll temperature was varied from cold offset to hot offset or up to 220° C. for gloss and crease measurements on the samples. After the set point temperature of the fuser roll has been changed, there is a wait time of ten minutes to allow the temperature of the belt and pressure assembly to stabilize.

Cold offset is the temperature at which toner sticks to the fuser, but is not yet fusing to the paper. Above the cold offset temperature the toner does not offset to the fuser until it reaches the Hot offset temperature.

Crease Area. The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard Teflon™ coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 millimeters correspond to about 1 mm in width. Further, the images exhibit fracture coefficients, for example of greater than unity.

TABLE 2

| | Parent Charge | | | | Additive Charge | | | | | |
|---|---|---|---|---|---|---|---|---|---|---|
| | 10' Turbula | | | | 60' Turbula | | | | | Blocking |
| | q/d (mm) | | q/m (μC/g) | | q/d (mm) | | q/m (μC/g) | | Cohesion | Onset |
| Example | AZ | JZ | AZ | JZ | AZ | JZ | AZ | JZ | (%) | (° C.) |
| Comparative Example 5 | 4.1 | 22.2 | 34.7 | 182.7 | 7.2 | 12.4 | 57.3 | 116.6 | 6.6 | 53.2 |
| Example 1 | 4.6 | 26.7 | 40.6 | 198.2 | 7.0 | 14.0 | 60.9 | 125.0 | 5.0 | 52.6 |
| Example 2 | 3.2 | 17.6 | 17.6 | 134.9 | 6.4 | 9.0 | 59.5 | 91.6 | 7.0 | 53.2 |
| Example 3 | 3.1 | 16.6 | 18.1 | 134.7 | 6.4 | 10.1 | 54.1 | 80.0 | 6.4 | 53.1 |
| Example 4 | 2.3 | 20.8 | 23.4 | 108.1 | 5.9 | 10.3 | 52.1 | 92.4 | 10.2 | 54.1 |

From the image analysis of the creased area, it is possible to determine whether the image shows a small single crack line or is more brittle and easily cracked. A single crack line in the creased area provides a fracture coefficient of unity while a highly cracked crease exhibits a fracture coefficient of greater than unity. The greater the cracking, the greater the fracture coefficient.

Toners exhibiting acceptable mechanical properties, which are suitable for office documents, may be obtained by utilizing the aforementioned thermoplastic resins. However, there is also a need for digital xerographic applications for flexible packaging on various substrates. For flexible packaging applications, the toner materials must meet very demanding requirements such as being able to withstand the high temperature conditions to which they are exposed in the packaging process and enabling hot pressure-resistance of the images. Other applications, such as books and manuals, require that the image does not document offset onto the adjacent image. These additional requirements require alternate resin systems, for example that provide thermoset properties such that a crosslinked resin results after fusing or post-fusing on the toner image.

Minimum Fixing Temperature. The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Gloss. Print gloss (Gardner gloss units or "gu") was measured using a 75 degree BYK Gardner gloss meter for toner images that had been fused at a fuser roll temperature range of about 120° C. to about 210° C. (Sample gloss was dependent on the toner, the toner mass per unit area, the paper substrate, the fuser roll, and fuser roll temperature).

Gloss mottle. The gloss mottle temperature is the temperature at which the print shows a mottled texture, characterized by non-uniform gloss on the mm scale on the print, and is due to the toner beginning to stick to the fuser in small areas.

Hot offset. The hot offset temperature (HOT) is that temperature that toner that has contaminated the fuser roll is seen to transfer back onto paper. To observe it a blank piece of paper, a chase sheet, is sent through the fuser right after the print with the fused image. If an image offset is notice on the blank chase sheet at a certain fuser temperature then this is the hot offset temperature.

The four magenta bench scale samples used a combination of EDTA and HIDS to remove aluminum while maintaining acceptable process conditions and preventing particles from sticking together. With the higher residual aluminum levels of the inventive process, lower gloss levels are intended, as seen for Examples 3 and 4 with peak gloss 43.2 gu and 40.9 gu, respectively, compared to Comparative Example 5 with peak gloss of 61 gu. Crease fix MFT for all samples was within experimental certainty. Combining EDTA and HIDS in the process steps did not significantly impact fusing performance None of the samples offset toner to the fuser roll or showed signs of gloss mottle. Example 2 had a combination of 1.05 EDTA and 0.45% HIDS for a total of 1.50% chelating agent. The Comparative Example 5 with an equivalent amount of EDTA (1.50%) had very similar fusing performance to toners made with both EDTA and HIDS. The exception is that peak gloss (62 gu of Comparative Example 5 versus 58 gu of Example 2) is significantly higher due to the lower Al level (82 ppm of Comparative Example 5 versus 181 ppm of Example 2 based on the total concentration of the element in parts per million within the sample, compared to a calibration curve.). (See U.S. Pat. No. 9,454,095, incorporated by reference above.) Therefore, by using a combination of chelators, higher residual Al and lower gloss were obtained.

TABLE 3

| | Example 1 | Example 2 | Example 3 | Example 4 | Comparative Example 5 |
|---|---|---|---|---|---|
| Chelator | 1.05% EDTA + 0.45% HIDS | 1.05% EDTA + 0.45% HIDS | 0.56% EDTA + 0.45% HIDS | 0.56% EDTA + 0.45% HIDS | 1.5% EDTA |
| Residual Al (ppm) | 152.9 | 181.3 | 364.6 | 365.9 | 82.5 |
| Gloss @ MFT | 22.8 | 24.3 | 16.5 | 15.7 | 24.2 |
| Gloss @ 185° C. | 57.1 | 57.3 | 40.8 | 38.5 | 61.0 |
| Peak Gloss | 58.0 | 60.0 | 43.2 | 40.9 | 62.0 |
| HOT @ 220 mm/s | >221 | >221 | >221 | >221 | >221 |
| Gloss Mottle @ 220 mm/s | >221 | >221 | >221 | >221 | >221 |
| Cold Offset | 118 | 124 | 124 | 124 | 118 |
| Fix Latitude (CA = 80/COT) | >103/>103 | >97/>97 | >97/>97 | >97/>97 | >103/>103 |
| $T(G_{30})$ | 123 | 128 | 154 | 154 | 121 |
| $T(G_{40})$ | 136 | 145 | 182 | 195 | 135 |
| $T(G_{50})$ | 155 | 165 | / | / | 153 |
| $MFT_{(CA = 80)}$ | 115 | 118 | 119 | 116 | 114 |

TABLE 4

| | Comparative Example 5 |
|---|---|
| Chelator | 1.50% EDTA |
| Residual Al (ppm) | 82.5 |
| Gloss @ MFT | 24.2 |
| Gloss @ 185° C. | 61.0 |
| Peak Gloss | 62.0 |
| HOT @ 220 mm/s | >221 |
| Gloss Mottle @ 220 mm/s | >221 |
| Cold Offset | 118 |
| Fix $Latitude_{(CA = 80/COT)}$ | >103/>103 |
| $T(G_{30})$ | 121 |
| $T(G_{40})$ | 135 |
| $T(G_{50})$ | 153 |
| $MFT_{(CA = 80)}$ | 114 |

*Cold offset temperature, Fix Latitude = (HOT on CSX paper-MFT) or (Maximum Fuser Roll Temperature-MFT). Temperature to achieve acceptable fix.

Thus, an emulsion aggregation toner process is provided using two different chelating agents with differing ability to extract aluminum from the toner particle. Toner particles having desired characteristics were prepared using a combination of EDTA and HIDS. In embodiments, toner particles were prepared using 0.56% EDTA and 0.45% HIDS. It was found that lower amounts of HIDS, in embodiments, 0.45% HIDS, was effective to tie up loose aluminum in coalescence thus preventing coarse, but doesn't effectively remove aluminum from the particle, therefore keeping the gloss from increasing. The result is higher aluminum, enabling desired gloss. It was found that use of 1.50% EDTA without the use of HIDS can result in good toner particles, but the residual aluminum is much lower and the gloss level is elevated.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A toner process comprising:

a) mixing reagents comprising at least one amorphous resin, an optional crystalline resin, an optional styrene resin, an optional acrylate resin, or an optional styrene/acrylate resin, an optional wax, and an optional colorant to form an emulsion comprising a resin particle;

b) adding at least one aggregating agent and aggregating said resin particle to form a nascent toner particle;

c) optionally, adding one or more resins to form a shell on said nascent toner particle to yield a core-shell particle;

wherein the toner particle has a metal content;

d) adding a first chelating agent and a second chelating agent;

wherein said first chelating agent has a first ability to remove metal from the toner particle;

wherein said second chelating agent has a second ability to remove metal from the toner particle; and wherein said first ability to remove metal from the toner particle and said second ability to remove metal from the toner particle are different;

wherein the first chelating agent is ethylene diamine tetra acetic acid and wherein the second chelating agent is ethylene hydroxyiminodisuccinic acid;

e) freezing particle growth to form an aggregated toner particle;

f) coalescing said aggregated toner particle to form a toner particle; and g) optionally, collecting said toner particle.

2. The toner process of claim 1, wherein said first chelating agent has the characteristic of removing a first amount of metal from the toner particle;

wherein said second chelating agent has the characteristic of removing a second amount of metal from the toner particle; and wherein the first amount of metal is greater than the second amount of metal.

3. The toner process of claim 1, wherein said first chelating agent and said second chelating agent are added during e) freezing.

4. The toner process of claim 1, wherein said first chelating agent is added in an amount of from 0.1 to 1.1 percent by weight, based upon the total weight of the reagents used in the toner process.

5. The toner process of claim 1, wherein said second chelating agent is added in an amount of from 0.1 to 1.1 percent by weight, based upon the total weight of the reagents used in the toner process.

6. The toner process of claim 1, wherein said aggregating step b) is performed at a temperature of from 40 to 50° C.

7. The toner process of claim 1, wherein said freezing step e) is performed at a temperature of from 40 to 50° C.

8. The toner process of claim 1, wherein the toner particle of f) had a volume average particle diameter of from 4 to 5 micrometers.

9. The toner process of claim 1, wherein the formed toner particle of f) comprises a residual metal content of from 100 to 500 parts per million.

10. The toner process of claim 1, wherein the formed toner particle of f) comprises an aluminum content of greater than 150 parts per million.

* * * * *